US007267089B2

(12) United States Patent
Fattorusso

(10) Patent No.: US 7,267,089 B2
(45) Date of Patent: Sep. 11, 2007

(54) MANUALLY GUIDED IMPLEMENT HAVING A SPARK PLUG CONNECTOR ARRANGEMENT

(75) Inventor: Antonio Fattorusso, Leinfelden-Echterdingen (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/293,970

(22) Filed: Dec. 5, 2005

(65) Prior Publication Data

US 2006/0124097 A1 Jun. 15, 2006

(30) Foreign Application Priority Data

Dec. 15, 2004 (DE) ..... 10 2004 060 226

(51) Int. Cl.
*H01T 13/04* (2006.01)
*F02P 15/00* (2006.01)

(52) U.S. Cl. ..... 123/169 PA; 439/128

(58) Field of Classification Search ..... 123/143 C, 123/169 PA; 29/280, 764; 439/125, 128
See application file for complete search history.

(56) References Cited

U.S. PATENT DOCUMENTS 3,174,216 A * 3/1965 Hamilton ..... 29/235
3,935,852 A * 2/1976 Donovan et al. ..... 123/169 PA
4,125,938 A * 11/1978 Clark ..... 29/764
4,202,088 A * 5/1980 Hansen ..... 29/280
4,425,697 A * 1/1984 Simmons ..... 29/280
5,186,132 A * 2/1993 Runge ..... 123/169 R
5,253,408 A * 10/1993 Wright ..... 29/280

* cited by examiner

*Primary Examiner*—T. M. Argenbright
(74) *Attorney, Agent, or Firm*—Robert W. Becker & Associates; Robert W. Becker

(57) ABSTRACT

A manually guided implement comprising an engine housing that at least partially surrounds a cylinder of an internal combustion engine. The engine housing has a wall provided with an opening for a spark plug that is disposed in the cylinder. A spark plug connector arrangement is placed over the outside of the spark plug and extends through the spark plug opening. Externally of the wall of the engine housing the spark plug connector arrangement is provided with a mechanism for insertion or application of a tool.

15 Claims, 3 Drawing Sheets

MANUALLY GUIDED IMPLEMENT HAVING A SPARK PLUG CONNECTOR ARRANGEMENT

The instant application should be granted the priority date of Dec. 15, 2004, the filing date of the corresponding German patent application 10 2004 060 226.3.

BACKGROUND OF THE INVENTION

The present invention relates to a manually guided or portable implement, especially a power chain saw, a brush cutter, a trimmer, or the like.

To operate a tool, such manually guided implements have an internal combustion engine, the cylinder of which is at least partially surrounded by an engine housing. In the region of the cylinder, the engine housing serves for the guidance of a cooling air stream that passes by the cylinder. The heat of combustion that is produced in the cylinder is absorbed by the cooling air stream, thus heating the latter.

To form a fuel/air mixture for operating the internal combustion engine, combustion air is drawn in that should have as great a density as possible for achieving a high engine output. For a correspondingly high air density, a temperature of the intake air that is as low as possible is desired. In this connection, the engine housing also serves to separate the cool atmospheric air from the heated-up cooling air stream in the intake region in order to avoid an undesirable heating and hence an accompanying loss of density in the intake air stream.

For maintenance work, especially at the location of use, it is necessary to have good access to the spark plug that is threaded into the cylinder. The spark plug, together with a spark plug connector arrangement that is placed on the spark plug for supplying it with an ignition voltage, extends through an opening in a wall of the engine housing for the spark plug. The spark plug connector arrangement can be pulled off from the outside, thus providing access to the spark plug for inspecting or replacing it. During removal of the spark plug connector arrangement, parts of the surrounding engine housing, and in particular the wall having the opening for the spark plug, can interfere and be in the way. It is difficult to remove the spark plug connector arrangement manually without a tool. For good electrical high voltage insulation, the outside of a spark plug connector is surrounded by a soft, elastomeric material that can be easily damaged when a tool is applied for lifting the spark plug connector arrangement off.

At the same time, it is desired to have as small a configuration of the opening for the spark plug as possible in order to limit the amount of heated-up cooling air that escapes. The small configuration of the opening for the spark plug, and the surrounding wall or housing components, limit the accessibility of the spark plug connector arrangement.

It is therefore an object of the present application to improve a manually guided implement in such a way that it is more maintenance friendly.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
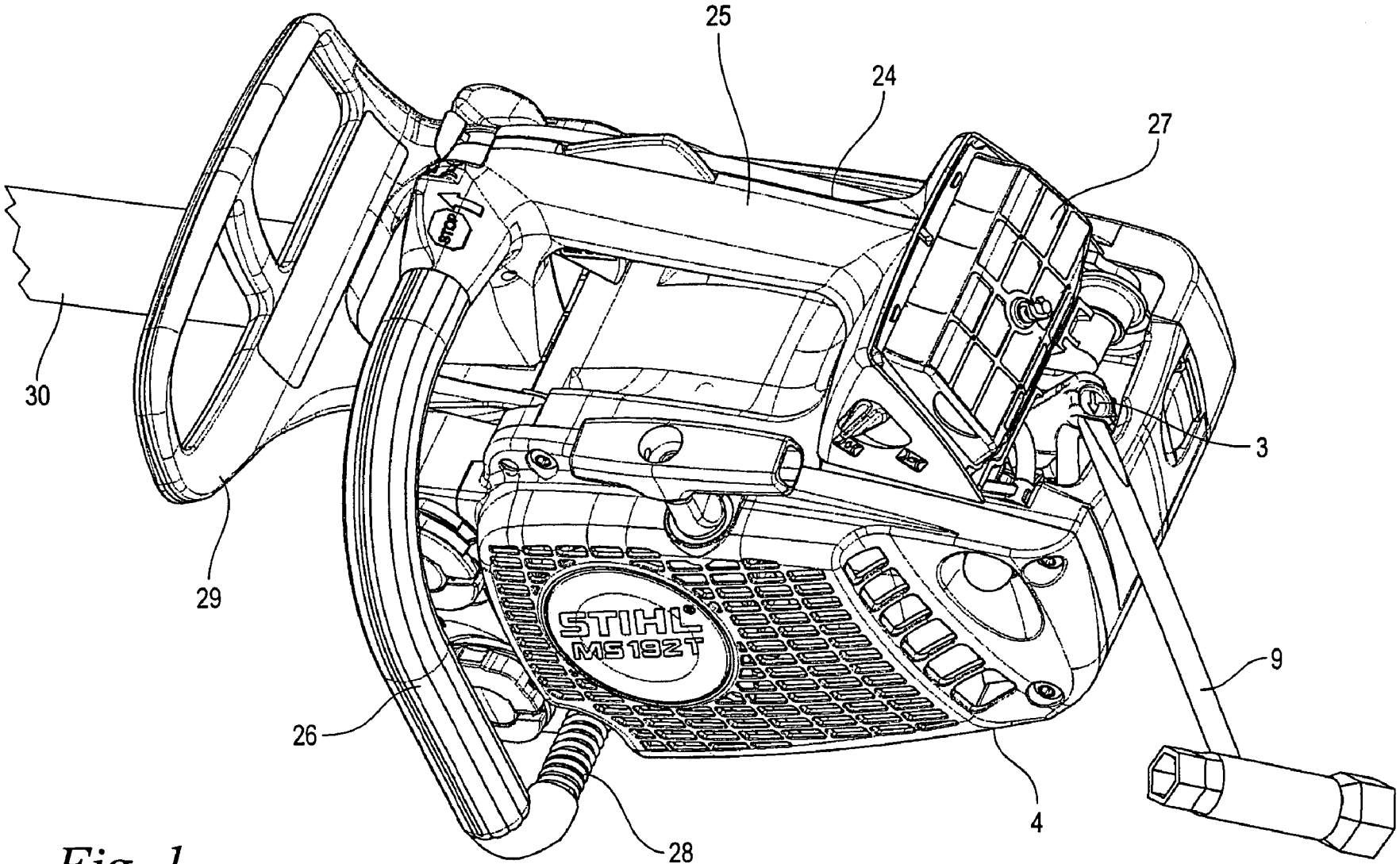
FIG. 1 is a perspective illustration of a manually-guided implement, by way of example a power chain saw, that has a spark plug connector arrangement that is partially covered by an air filter compartment, and also shows an assembly tool placed thereon.

Pursuant to the manually guided implement of the present application, externally of the wall of the engine housing the spark plug connector arrangement is provided with means for insertion or application of an assembly tool. The spark plug connector arrangement, which is appropriately integrated into the wall of the engine housing, can, via the tool insertion or application point that is expressly provided for this purpose, be easily pulled or lifted off by means of an assembly tool, even under spatially limited conditions. The configuration of the spark plug connector arrangement with its own tool insertion or application point avoids damage, in particular to the high voltage installation, when the assembly tool is applied.

Pursuant to an advantageous further development, the tool insertion or application point is embodied as a tool slot for a blade or flattened section, for example of a screwdriver. The slot shape provides for a precisely positioned introduction of the blade. A relatively large contact surface results with low surface pressure. During levering-off of the spark plug connector arrangement, slippage of the blade is avoided. The risk of damage is reduced.

The tool insertion or application point is expediently provided in the region of an outer cover or top portion of the spark plug connector arrangement. The outer cover is disposed on the side that faces the operator, and is easily accessible. In particular, this cover is disposed externally of the high voltage cable that is introduced into the spark plug connector. This avoids damage to the ignition cable from the applied assembly tool.

In the assembled state, the spark plug connector arrangement is preferably disposed relative to the engine housing in such a way that the edge of the engine housing serves as an abutment edge for the assembly tool, and is disposed on a line that is at the level of the tool insertion or application point and is perpendicular to a longitudinal axis of the spark plug connector arrangement. After application of the assembly tool to the tool insertion or application point, to form a lever arrangement the tool can be pressed against the abutment edge, and the spark plug connector arrangement can be lifted or levered-off. The geometrical relative arrangement of the tool insertion or application point and the abutment edge that has been described effects an approximately right-angled orientation of the assembly tool relative to the longitudinal axis or direction of withdrawal of the spark plug connector arrangement. Optimal lever conditions are established that make it possible to lever the arrangement off with little application of force.

Pursuant to one advantageous embodiment, the spark plug connector arrangement includes a spark plug connector and a separate protective cover, whereby the protective cover is provided with the tool insertion or application point. The separate configuration of the two components permits a separate, independent selection of the material thereof. For example, the spark plug connector can be designed for an optimum high voltage guidance and installation, while the protective cover can be optimized with regard to its mechanical loading as an element for the application of a tool and also has a sealing element. For this purpose, it is expedient to form the protective cover from a material that is more rigid than is the material of the spark plug connector. The rigidity of the material is in particular between that of the elastomeric insulating material of the spark plug connector and the relatively rigid wall of the engine housing. In this way, on the one hand the material is rigid enough to absorb the load of the applied assembly tool, and on the other hand is elastic enough to provide a position-tolerance compensation between the protective cover, i.e. the sealing collar thereof, and the edges of the spark plug opening that are to be sealed off.

Pursuant to one expedient embodiment, the tool slot that forms the tool insertion or application point is delimited by the top portion of the protective cover and by a head or top portion of the spark plug connector disposed therebelow. With a simple geometrical shape, a good guidance of the inserted tool is ensured. An intentional resilience of the top portion of the protective cover, and in particular of the elastomeric head or top portion disposed therebelow, can lead to a clamping effect upon the tool, which contributes to a protection against slipping.

The protective cover and the spark plug connector are expediently interconnected in a form-fitting manner relative to the longitudinal axis of the connector arrangement. The lever or withdrawal forces that act upon the protective cover can be reliably transmitted to the spark plug connector disposed therebelow without having to worry that the protective cover will be lifted from the spark plug connector.

The protective cover preferably has an assembly opening for the extension therethrough of an ignition cable of the spark plug connector, whereby a high voltage connector of the spark plug connector projects at an angle and rests against a support edge of the assembly opening that is disposed in a direction of the longitudinal axis. The connector arrangement is easy to assemble by extending the spark plug connector, together with its high voltage connector, through the assembly opening and engaging it therein in a form-fitting manner. The support edge, and the high voltage connector that rests thereagainst, effect an effective positive transfer of force, especially in the longitudinal direction, from the protective cover to the spark plug connector when a corresponding pulling force is applied to the cover.

To improve the positive transfer of force, and to reduce the stress upon the material, the protective cover is advantageously provided with an outwardly projecting support surface that proceeds from the support edge and that is provided for supporting the high voltage connector. A surface-like contact area with low surface pressure results. The support surface is in particular embodied as a dished or curved support chute. The dishing effects a lateral guidance or position fixation of the high voltage connector. The dished cross-section increases the inherent stability and hence the carrying capacity of the arrangement.

Pursuant to an advantageous further development, the assembly opening provides the access to the tool slot. Separate means for the introduction of the assembly tool are not required. A geometrically straightforward construction that is easy to produce results.

Pursuant to one expedient embodiment, the spark plug connector arrangement is provided with an at least partially encircling sealing collar for sealing the opening for the spark plug. The sealing collar effects a sealing of the spark plug opening and hence an improved guidance of the cooling air stream. In particular, a good separation of the heated cooling air from the intake air stream, which is to be kept as cool as possible, is achieved. In conjunction with the previously described tool insertion or application point, a good sealing effect is associated with a straightforward maintenance accessibility.

Further specific features of the present application will be described in detail subsequently.

DESCRIPTION OF SPECIFIC EMBODIMENTS

Referring now to the drawings in detail, the perspective view of FIG. 1 shows a manually-guided implement, in this case a power chain saw. However, the implement can also be a brush cutter, a trimmer, a cut-off machine, a suction/blower device, or the like. The illustrated power chain saw includes a non-illustrated internal combustion engine, which is disposed in an engine housing 4. Provided at one end of the power chain saw is an indicated guide bar 30, on the peripheral edge of which is disposed a cutting chain that can be driven by the internal combustion engine.

Provided for guiding the power chain saw, relative to the indicated customary operating position, is a grip member 24, having a rear handle 25 and a front handle 26, above the engine housing 4. On its rear side, the grip member 24 also has an air filter compartment 27 for drawing in and cleaning combustion air for the internal combustion engine. The grip member 24 is secured to the engine housing 4 in a vibration-neutralizing manner via vibration elements 28. Disposed between the front handle 26 and the guide bar 30 is a brake lever 29 for actuating a safety brake.

During operation of the illustrated power chain saw, the air filter compartment 27, and a spark plug connector arrangement 3 located below it, are covered with a non-illustrated cover that in the illustration of FIG. 1 is removed for maintenance work. With the cover removed, access is possible to the air filter contained in the air filter compartment 27, and to the difficult to access spark plug connector arrangement 3 located therebelow. With the illustrated embodiment of the power chain saw as a so-called "Top-Handle" configuration having handle 25 and air filter compartment 27 located above the engine housing 4, it is clear that the spark plug connector arrangement 3 is substantially surrounded by parts of the engine housing 4 and the air filter compartment 27, consequently making manual access to the spark plug connector arrangement 3 difficult. To remove the spark plug connector arrangement 3, an assembly tool, for example a universal wrench, is applied.

In the configuration of the power chain saw according to FIG. 1, access to the inventively embodied spark plug connector arrangement 3 for maintenance work is effected with the cover removed and with the grip member 24 installed. To facilitate illustration, in FIG. 2 the power chain saw of FIG. 1 is shown with the grip member 24, including the air filter compartment 27, removed. It should be understood that a spark plug 2 is threaded into a cylinder 1 of the internal combustion engine. The cylinder 1 is at least nearly completely surrounded by the engine housing 4 for guidance of a cooling air stream. Part of the engine housing 4 is a wall 6 that is disposed in the direction of the air filter compartment 27 (FIG. 1) and through which an intake channel 31 of the internal combustion engine extends. During operation, the intake channel 31 is in flow-conducting communication with the air filter compartment 27 of FIG. 1. The combustion air drawn in through the air filter compartment 27 is processed in a non-illustrated carburetor to produce a fuel/air mixture, and is guided through the intake channel 31 into the internal combustion engine, i.e. into the cylinder 1.

Placed over the spark plug 2 is a spark plug connector arrangement 3 that, via a high voltage ignition cable 20, supplies ignition power to the spark plug 2, as a result of which the fuel/air mixture in the cylinder 1 is ignited.

The wall 6 of the engine housing 4, which separates the cylinder 1 and the space surrounding it from the air filter compartment 27 (FIG. 1) and from the intake channel 31 that adjoins the air filter compartment, is provided with an opening 5 for the spark plug 2 through which the spark plug extends, with the spark plug connector arrangement 3 being placed on. On the outside, the spark plug connector arrangement 3 is provided with a partially encircling sealing collar 7 that extends at an angle to the longitudinal axis 15 of the spark plug connector arrangement, i.e. in the plane of the wall 6. The sealing collar 7 fills the opening 5 for the spark plug 2 and seals the opening 5 relative to flow such that the cooling air stream that flows about the cylinder 1 and is warmed by the heat of combustion cannot pass to the air filter compartment 27 (FIG. 1).

On its outer end face, the spark plug connector arrangement 3 is provided with a cover or top portion 12, in a region of which is provided a tool insertion or application point 8 for the assembly tool 9, whereby the tool insertion or application point 8 is disposed externally of the wall 6, i.e. of the opening 5 for the spark plug 2. In the illustrated embodiment, the assembly tool 9 is provided with a blade or flattened section 11, such as found on a screwdriver, that is inserted into the tool insertion or application point 8, which is embodied as a tool slot 10.

In the illustrated assembled state, the spark plug connector arrangement 3 is disposed relative to the engine housing 4 in such a way that an edge 13 of the engine housing 4 serves as an abutment edge for the assembly tool 9. Extending through the abutment edge 13 is a dot-dash line 14 as a perpendicular to the longitudinal axis 15 of the spark plug connector arrangement 3 or of the spark plug 2, whereby the perpendicular 14 extends at least approximately through the tool insertion or application point 8. The assembly tool 9, which is placed against the tool insertion or application point 8 and rests in a lever-like manner against the edge 13, is consequently at least approximately perpendicular to the longitudinal axis 15. The edge 13 acts as a fulcrum about which the spark plug connector arrangement 3 can, by means of the assembly tool 9, be levered off from the spark plug 2 out of its illustrated installed position in the direction of the longitudinal axis 15. Instead of a lever arrangement, it could also be expedient to provide a removal or withdrawal device that is linearly actuatable in the direction of the longitudinal axis 15.

Figure 2:
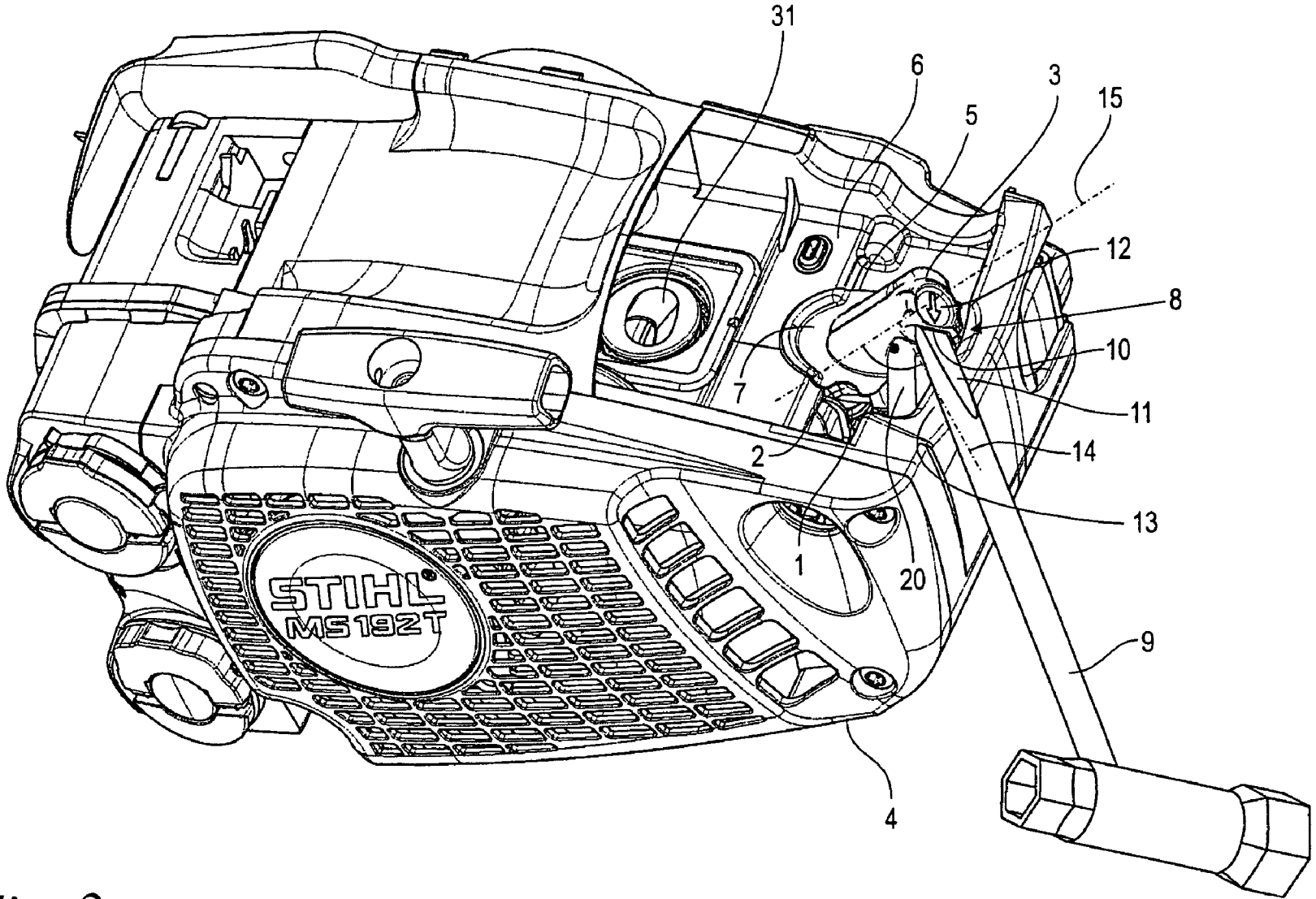
FIG. 2 shows the arrangement of FIG. 1 with the handle arrangement removed, and also shows the exposed spark plug connector arrangement.
Figure 3:
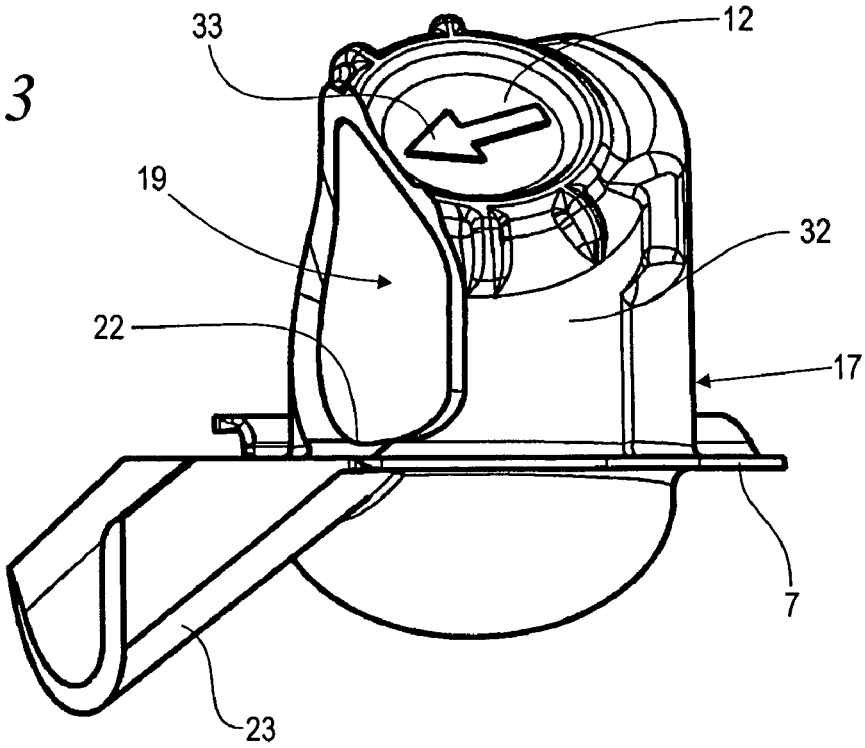
FIG. 3 is an enlarged side view of a protective cover as part of the spark plug connector arrangement of FIGS. 1 and 2.
Figure 4:
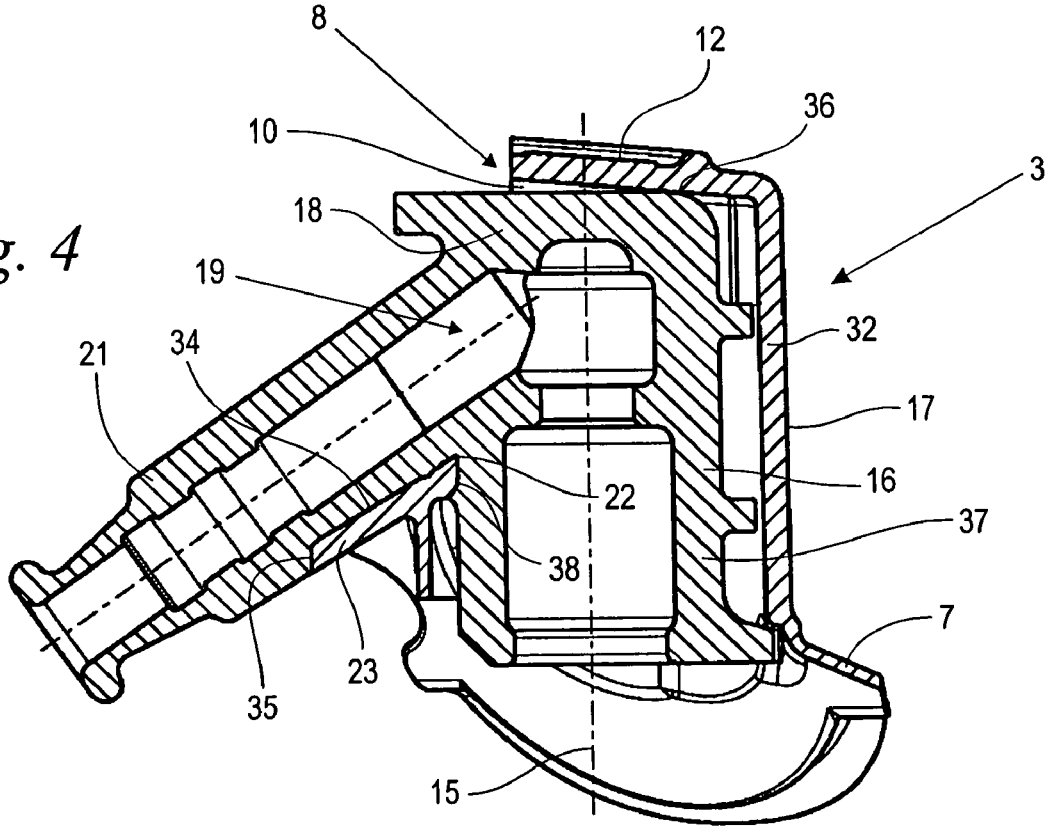
FIG. 4 is a longitudinal cross-sectional view through the protective cover of FIG. 3 with an inserted spark plug connector.

Part of the spark plug connector arrangement 3 of FIGS. 1 and 2 is a protective cover 17, which is shown in a side view in FIG. 3 (see also the cross-sectional view of FIG. 4). The protective cover 17 comprises an approximately cylindrical main body 32 having the top portion 12 at the end face, and also comprises the partially encircling sealing collar 7 that extends at an inclined angle. Disposed on the top portion 12 is an arrow-shaped marking 13 that makes it easier for the operator to introduce the blade 11 into the tool slot 10 (FIG. 2). On its periphery, the main body 32 is provided with an assembly opening 19 that in the opposite axial direction, relative to the top portion 12, is delimited by a support edge 22. Adjoining the support edge 22 and the sealing collar 7 is a support surface 23 that projects outwardly at an angle from the main body 32 of the protective cover 17. In the illustrated embodiment, the support surface 23 is embodied as a support chute that in cross section is dished or curved in a U-shaped manner.

FIG. 4 shows the spark plug connector arrangement 3 of FIGS. 1 and 2 in a longitudinally cross-sectioned view, including the protective cover 17 and a spark plug connector 16 that is separate therefrom and is embodied as a separate component. Projecting outwardly at an angle from the spark plug connector 16 is an approximately tubular high voltage connector 21, which is provided for receiving the ignition cable 20 (FIG. 2).

The periphery of a main body 37 of the spark plug connector 16 is held in the main body 32 of the protective cover 17. The top portion 12 of the cover 17 is slightly inclined relative to the longitudinal axis 15, as a consequence of which it rests in an airtight manner on a narrow contact surface 36 of an upper head or top portion 18 of the spark plug connector 16. Radially across from the contact surface 36 the tool slot 10, as the tool insertion or application point 8, is formed between the inclined top portion 12 and the head 18, which extends at right angles to the longitudinal axis 15.

The high voltage connector 21 extends through the assembly opening 19 of the protective cover 17. The underside of the high voltage connector 21 is provided with a recessed area 34 that in its axial direction is delimited by two edges 35 and 38. The support surface 23 engages in the recessed area 34 in a form-fitting manner, whereby the support edge 22 rests against the edge 38 of the recessed area 34. In conjunction with the contact surface 36, there results in every spatial direction, and in particular in the direction of the longitudinal axis 15, a positive connection between the spark plug connector 16 and the protective cover 17.

With respect to the longitudinal axis 15, the tool slot 10 is delimited in one direction by the top portion 12, and in the opposite direction by the top portion 18. In this connection, the tool slot 10 opens in a wedge-shaped manner in the direction of the assembly opening 19, which in addition to allowing the high voltage connector 21 to pass through also permits an introduction of the blade 11 (FIG. 2) into the tool slot 10. The spark plug connector 16 is made of a relatively soft, elastomeric material that has good insulating properties, while the protective cover 17 is made of a polymeric material that is harder than the material of the connector 16, with the cover 17 being an injection molded component. The pairing of the materials is such that the protective cover 17, as a consequence of its clamping force and elasticity, surrounds the spark plug connector 16 in an at least nearly airtight manner. The sealing effect of the sealing collar 17 in the opening 5 of the spark plug 2 (FIG. 2) is thereby enhanced. At the same time, the soft, elastic material of the spark plug connector 16 in the region of its head or top portion 18 leads to a clamping effect on the blade 11 (FIG. 2) that is inserted into the tool slot 10. The polymeric material of the protective cover 17 is elastic enough that the top portion 12 can deflect outwardly, in the direction of the longitudinal axis 15, for a clamping introduction of the blade 11 into the tool slot 10 in the direction of the longitudinal axis 15. At the same time, the material of the protective cover 17 is rigid and hard enough that the spark plug connector arrangement 3 can be lifted off of the spark plug 2 (FIG. 2) in the direction of the longitudinal axis 15.

Instead of the illustrated two-part configuration, with a spark plug connector 16 and a separate protective cover 17, a one-piece configuration can also be expedient. Furthermore, it can also be advantageous, instead of the tool slot 10 disposed between the top portion 12 and the top portion 18, to form a tool insertion or application point 8 entirely in the protective cover 17 without any influence from the spark plug connector 16. In addition to the preferred embodiment of the tool slot 10, other configurations of the tool insertion or application point 8 can also be expedient.

The specification incorporates by reference the disclosure of German priority document 10 2004 060 226.3 filed Dec. 15, 2004.

The present invention is, of course, in no way restricted to the specific disclosure of the specification and drawings, but also encompasses any modifications within the scope of the appended claims.

What I claim is:

1. A manually guided implement, comprising:

an internal combustion engine having a cylinder;

a spark plug disposed in said cylinder;

an engine housing that at least partially surrounds said cylinder, wherein said engine housing has a wall that is provided with an opening for said spark plug; and a spark plug connector arrangement placed over the outside of said spark plug and extending through said spark plug opening, wherein externally of said wall of said engine housing said spark plug connector arrangement is provided with means for insertion or application of a tool that is adapted to pull or lift off said spark plug connector arrangement, wherein said means for insertion or application of a tool is a tool slot for said tool.

2. An implement according to claim 1, wherein said means for insertion or application of a tool is a tool slot for a blade of said tool.

3. An implement according to claim 2, wherein said tool is a screwdriver.

4. An implement according to claim 1, wherein said means for insertion or application of a tool is provided in a region of an outwardly disposed portion of said spark plug connector arrangement.

5. A manually guided implement, comprising:

an internal combustion engine having a cylinder;

a spark plug disposed in said cylinder;

an engine housing that at least partially surrounds said cylinder, wherein said engine housing has a wall that is provided with an opening for said spark plug; and a spark plug connector arrangement placed over the outside of said spark plug and extending through said spark plug opening, wherein externally of said wall of said engine housing said spark plug connector arrangement is provided with means for insertion or application of a tool, and wherein in an installed state, said spark plug connector arrangement is disposed relative to said engine housing in such a way that an edge of said engine housing serves as an abutment edge for said tool and lies on a line that is disposed at the level of said means for insertion or application of a tool and perpendicular to a longitudinal axis of said spark plug connector arrangement.

6. An implement according to claim 1, wherein said spark plug connector arrangement includes a spark plug connector and a separate protective cover, wherein said protective cover is provided with said means for insertion or application of a tool.

7. An implement according to claim 6, wherein said protective cover is made of a material that is more rigid than is the material of said spark plug connector.

8. A manually guided implement, comprising:

an internal combustion engine having a cylinder;

a spark plug disposed in said cylinder;

an engine housing that at least partially surrounds said cylinder, wherein said engine housing has a wall that is provided with an opening for said spark plug; and a spark plug connector arrangement placed over the outside of said spark plug and extending through said spark plug opening, wherein externally of said wall of said engine housing said spark plug connector arrangement is provided with means for insertion or application of a tool, wherein said spark plug connector arrangement includes a spark plug connector and a separate protective cover, wherein said protective cover is provided with said means for insertion or application of a tool, wherein said means for insertion or application of a tool is a tool slot, wherein said protective cover has a top portion, wherein said spark plug connector has a top portion that is disposed below said top portion of said protective cover, and wherein said tool slot is delimited by said top portion of said protective cover and by said top portion of said spark plug connector.

9. An implement according to claim 6, wherein said protective cover and said spark plug connector are interconnected in a form-fitting manner relative to a longitudinal axis of said spark plug arrangement.

10. An implement according to claim 9, wherein said protective cover is provided with an assembly opening for the extension therethough of an ignition cable for said spark plug connector, wherein said spark plug connector is provided with a high voltage connector that projects at an angle, and wherein said high voltage connector rests against a support edge of said assembly opening that is disposed in the direction of said longitudinal axis.

11. An implement according to claim 10, wherein said protective cover is provided with an outwardly projecting support surface that proceeds from said support edge of said assembly opening, and wherein said support surface is provided for supporting said high voltage connector.

12. An implement according to claim 11, wherein said support surface is in the form of a dished support chute.

13. An implement according to claim 10, wherein said means for insertion or application of a tool is a tool slot, and wherein said assembly opening provides access to said tool slot.

14. An implement according to claim 6, wherein said spark plug connector arrangement is provided with an at least partially encircling sealing collar for sealing said spark plug opening.

15. An implement according to claim 14, wherein said protective cover of said spark plug connector arrangement is provided with said sealing collar.

* * * * *